US006751326B2

(12) United States Patent
Nepomuceno

(10) Patent No.: US 6,751,326 B2
(45) Date of Patent: Jun. 15, 2004

(54) VIBRATION-DAMPENING RECEIVER ASSEMBLY

(75) Inventor: Henry G. Nepomuceno, Glendale Heights, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 09/809,130

(22) Filed: Mar. 15, 2001

(65) Prior Publication Data

US 2001/0036289 A1 Nov. 1, 2001

Related U.S. Application Data

(60) Provisional application No. 60/189,517, filed on Mar. 15, 2000.

(51) Int. Cl.[7] ..... H04R 25/00

(52) U.S. Cl. ..... 381/322; 381/324; 381/328

(58) Field of Search ..... 381/322, 324, 381/325, 327, 328, 330, 370, 380, FOR 126, FOR 133, FOR 135, FOR 150, 309; 181/129, 130, 135

(56) References Cited

U.S. PATENT DOCUMENTS

| | | | | |
|---|---|---|---|---|
| 3,588,383 A | | 6/1971 | Carlson et al. | |
| 3,671,684 A | | 6/1972 | Tibbetts et al. | |
| 4,272,654 A | | 6/1981 | Carlson | |
| 4,440,982 A | | 4/1984 | Kaanders et al. | |
| 4,447,677 A | * | 5/1984 | Miyahra | 381/324 |
| 4,620,605 A | | 11/1986 | Gore et al. | |
| 4,729,451 A | | 3/1988 | Brander et al. | |
| 4,763,752 A | * | 8/1988 | Haertl et al. | 381/324 |
| RE33,718 E | | 10/1991 | Carlson et al. | |
| 5,193,116 A | | 3/1993 | Mostardo | |
| 5,335,286 A | | 8/1994 | Carlson et al. | |
| 5,404,408 A | * | 4/1995 | Strohmaier et al. | 381/330 |
| 5,610,989 A | | 3/1997 | Salvage et al. | |
| 5,692,060 A | | 11/1997 | Wickstrom | |
| 5,740,261 A | | 4/1998 | Loeppert et al. | |
| 5,809,151 A | | 9/1998 | Husung | |
| 5,887,070 A | * | 3/1999 | Iseberg et al. | 381/328 |

FOREIGN PATENT DOCUMENTS

| | | |
|---|---|---|
| DE | 199 54 880 C | 1/2001 |
| EP | 0 354 698 A | 2/1990 |
| WO | WO 95/07014 | 3/1995 |
| WO | WO 01 43498 A | 6/2001 |

* cited by examiner

*Primary Examiner*—Huyen Le
(74) *Attorney, Agent, or Firm*—Marshall, Gerstein & Borun LLP

(57) ABSTRACT

A receiver assembly for a hearing aid device, the assembly comprising a case having an inner cavity, one or more mounts disposed within the inner cavity of the case, and a receiver disposed within the inner cavity of the case and connected to the mounts such that the receiver is suspended within the inner cavity of the case. The mounts dampen any vibration transmission from the receiver to the case and from the case to the receiver. Most significantly, acoustical noise from the receiver and any resulting distortion, feedback, and/or interference within the other components of the hearing aid device are substantially eliminated.

2 Claims, 5 Drawing Sheets

VIBRATION-DAMPENING RECEIVER ASSEMBLY

RELATED APPLICATIONS

This application claims priority to Provisional Application Ser. No. 60/189,517, filed Mar. 15, 2000.

TECHNICAL FIELD

The present invention relates to electro-mechanical acoustic transducers, and more particularly to miniaturized electroacoustic receiver transducers for use in miniaturized electronic devices, such as hearing aids.

BACKGROUND OF THE INVENTION

Electroacoustic transducers are capable of converting electric energy to acoustic energy and vice versa. Electroacoustic receivers typically convert electric energy to acoustic energy through a motor assembly having a movable armature. Typically, the armature has one end that is free to move while the other end is fixed to a housing of the receiver. The assembly also includes a drive coil and one or more magnets, both capable of magnetically interacting with the armature. The armature is typically connected to a diaphragm near its movable end. When the drive coil is excited by an electrical signal, it magnetizes the armature. Interaction of the magnetized armature and the magnetic fields of the magnets causes the movable end of the armature to vibrate. Movement of the diaphragm connected to the armature produces sound for output to the human ear. Examples of such transducers are disclosed in U.S. Pat. Nos. 3,588,383, 4,272,654 and 5,193,116.

Vibration of the armature and the receiver housing may cause acoustical noise in other components of the electronic device, such as a microphone. Such acoustical noise may cause distortion and feedback within the microphone, thereby reducing the quality of the device. Thus, there is a need to isolate other components of the electronic device from the vibrations created by the armature of the receiver.

It is therefore an object of the present invention to provide a receiver assembly that is capable of isolating vibration created by the receiver from other components within the electronic device, such as a hearing aid.

It is also an object of the present invention to provide a receiver assembly that is capable of isolating the receiver from vibration created externally from the receiver.

These and other objects will become readily apparent after reviewing the specification and drawings.

SUMMARY OF THE INVENTION

A receiver assembly for a hearing aid device, the assembly comprising a case having an inner cavity, one or more mounts disposed within the inner cavity of the case, and a receiver disposed within the inner cavity of the case and connected to the mounts such that the receiver is substantially suspended within the inner cavity of the case. The mounts are made of a material that is suitable to provide dampening of any vibration transmission from the receiver to the case. Most significantly, acoustical noise from the receiver and the resulting distortion, feedback, and/or interference within the other components of the hearing aid device is substantially eliminated.

DETAILED DESCRIPTION OF THE PREFERRED EMBODIMENTS

While the present invention will be described fully hereinafter with reference to the accompanying drawings, in which particular embodiments are shown, it is to be understood at the outset that persons skilled in the art may modify the invention herein described while still achieving the desired result of this invention. Accordingly, the description which follows is to be understood as a broad informative disclosure directed to persons skilled in the appropriate arts and not as limitations of the present invention.

Figure 1:
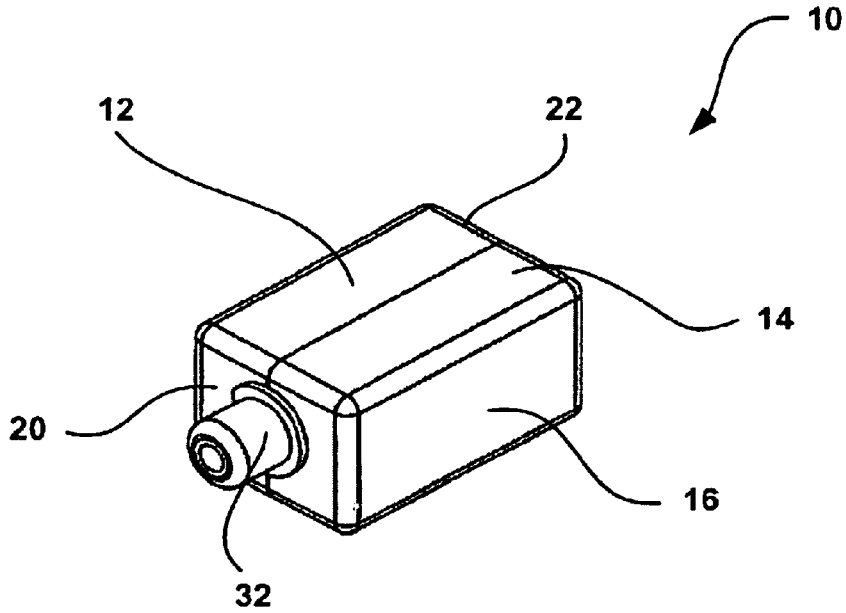
FIG. 1 is a perspective view of a first embodiment of the present invention.
Figure 2:
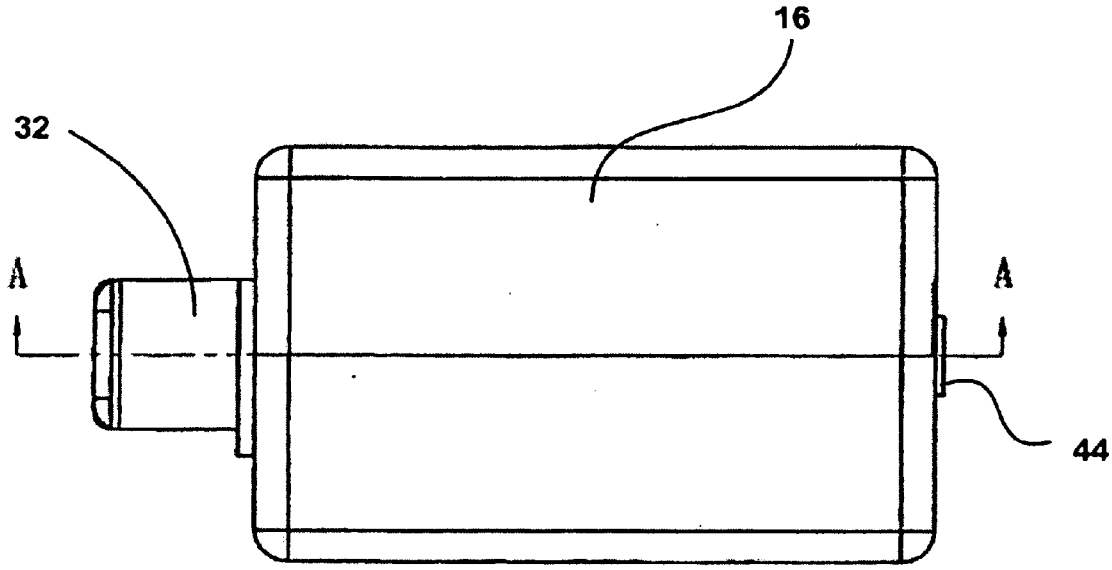
FIG. 2 is a top plan view of the embodiment shown in FIG. 1.
Figure 3:
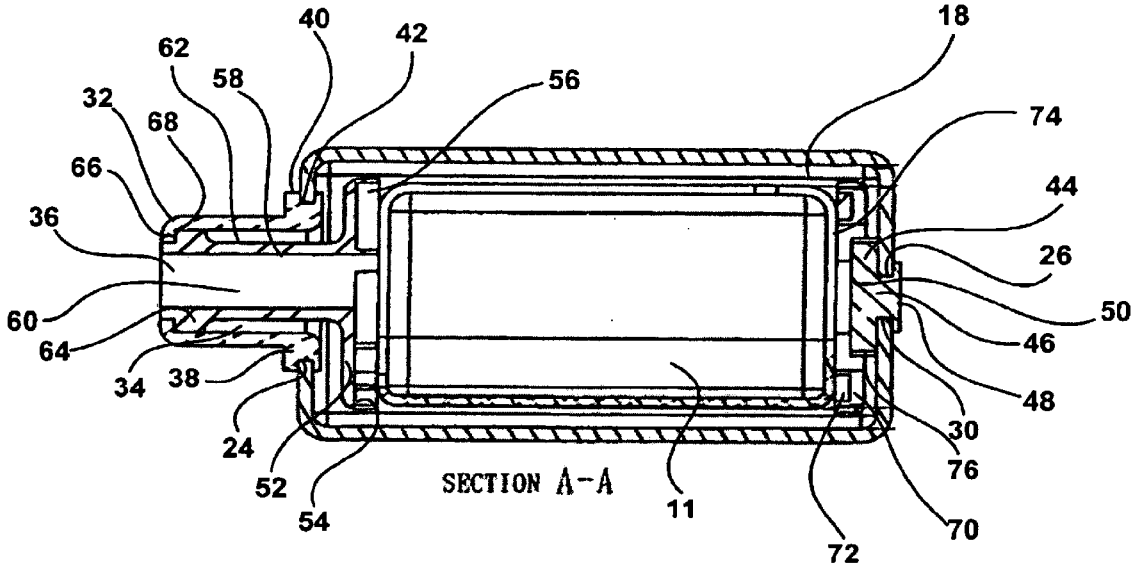
FIG. 3 is a cross-sectional side elevational view taken along section line A—A shown in FIG. 2.

A receiver assembly 10 of the present invention is shown in FIGS. 1–6. The receiver assembly 10 isolates a receiver 11 from vibration transmission, as shown in FIG. 3. The terms vibration and acoustical noise may be used interchangeably within this specification and are intended to have the same meaning. The receiver assembly 10 includes a first case half 12 and a second case half 14 that form an outer case 16, as shown in FIG. 1. The outer case 16 defines an inner cavity 18. The outer case 16 includes a first end surface 20 and a second end surface 22. The case 16 has a first aperture 24 within the first end surface 20 and a second aperture 26 within the second end surface 22. The first aperture 24 defines a first aperture edge surface 28 of the case 16. The second aperture 26 defines a second aperture edge surface 30 of the case 16. A hollow cylindrical sleeve 32 is disposed within the first aperture 24 and defines an outlet port 34 having a port opening 36. The cylindrical sleeve 32 includes an outwardly radially protruding annular shoulder 38 defining an outer annular surface 40. The outer annular surface 40 has an annular groove 42 therein. The first aperture edge surface 28 is mated with the annular groove 42 to secure the cylindrical sleeve 32 to the case 16. The cylindrical sleeve 32 may additionally be attached to the case 16 by other means, such as adhesive or through insert molding with the case 16. The sleeve 32 may also be integrally formed with the case 16.

A mounting pin 44 is disposed within the second aperture 26 of the case 16, as shown in FIG. 3. The mounting pin 44 includes a central pin portion 46, a first disk 48 disposed on one end of the central pin portion 46, and a second disk 50 disposed on the other end of the central pin portion 46. The first and second disks 48 and 50 are larger than the second aperture 26 of the case 16. The central pin portion 46 of the mounting pin 44 mates with the edge surface 30 of the case 16. The disks 48 and 50 prevent the mounting pin 44 from sliding out through the second aperture 26. In a preferred embodiment, the pin is made of metal. However, other materials, such as plastic or other polymeric resins may also be used.

Figure 5:
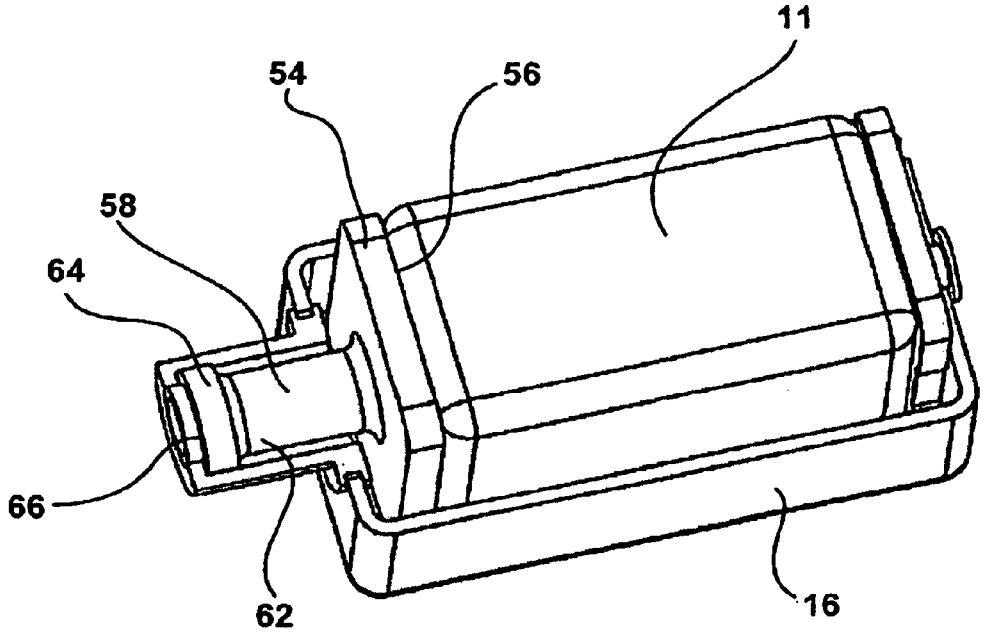
FIG. 5 is a first perspective cutaway view of the embodiment shown in FIG. 1 wherein one side of the case is cut away.

A first mount 52 of the receiver assembly 10 includes a mounting base 54 having a mounting surface 56 and a cylindrical extension 58 having a bore 60 extending therethrough, as shown in FIG. 3. The first mount 52 is preferably made of an elastomeric material, such as silicon rubber. However, any material that can be utilized as a vibration dampening spring may also be used. The durometer of the mount 52 varies according to the material used and the dimensions of the mount 52. The first mount 52 is positioned such that the cylindrical extension 58 is disposed within the cylindrical sleeve 28 and the mounting base 54 is disposed within the inner cavity 18 of the case 16. As shown in FIG. 3, the cylindrical extension 58 has an outer cylindrical surface 62 and includes an annular shoulder 64 that extends radially outwardly from the outer cylindrical surface 62. The shoulder 64 defines a shoulder surface 66 that mates with an annular surface 68 within the cylindrical sleeve 28. The shoulder 64 prevents the cylindrical extension 58 of the first mount 52 from moving outwardly past the port opening 36. The connection of the first mount 52 to the case 16 is best shown in FIG. 5. Alternatively, the first mount 52 may also be connected to the case 16 through insert molding or an adhesive. The first mount 52 may also be integrally formed with the case 16.

Figure 6:
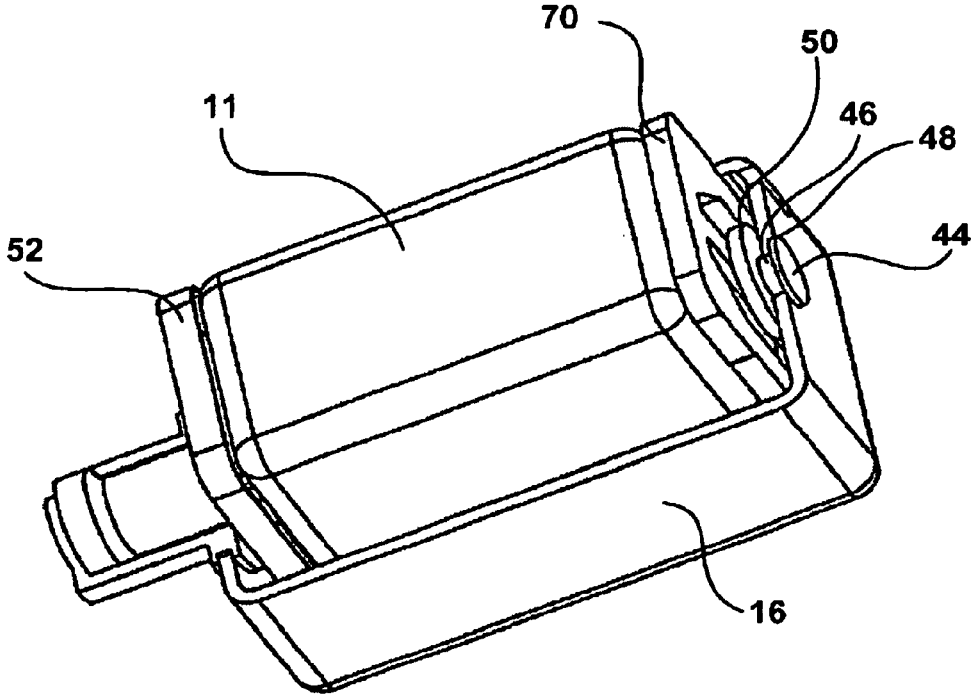
FIG. 6 is a second perspective cutaway view of the embodiment shown in FIG. 1 wherein one side of the case is cut away.

A second mount 70 of the receiver assembly 10 includes a mounting base 72 having a mounting surface 74 and a shallow cylindrical bore 76. The second mount 70 is disposed within the inner cavity 18 of the case 16 and secured to the case 16 by the mounting pin 44. Alternatively, the second mount may also be secured to the case by insert molding, adhesive, or integrally formed with the case 16. The second mount 70 is positioned such that the second disk 50 of the mounting pin 44 is disposed within the cylindrical bore 76 of the second mount 44. The second mount 70 is preferably made of an elastomeric material, such as silicon rubber. However, any material that can be utilized as a vibration dampening spring may also be used. As with the first mount 52, the durometer of the second mount 70 varies according to the material used and the dimensions of the second mount 70. The connection of the second mount 70 to the case 16 is best shown in FIG. 6.

Figure 4:
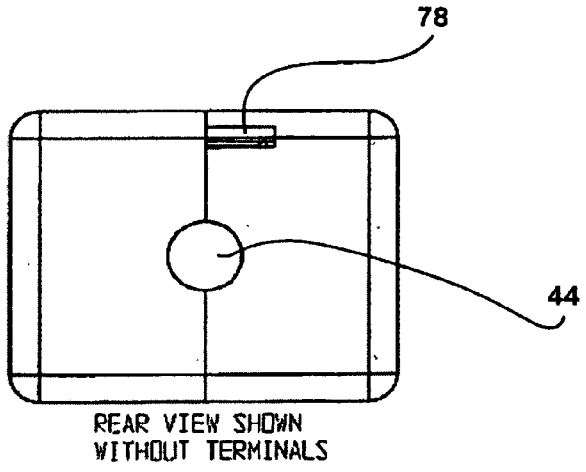
FIG. 4 is a side elevational view of the embodiment shown in FIG. 1.

The receiver 11 is disposed between the first and second mounts 52 and 70 and mounted to the mounting surfaces 56 and 74 of the mounts 52 and 70, as shown in FIG. 3. The receiver 11 may be mounted to the mounting surfaces 56 and 74 by any mechanical means, such as a fastener, adhesive, friction fit, compression fit, or the like. The mounts 52 and 70 may also be insert molded with the receiver housing. The receiver 11 is thereby suspended within the inner cavity 18 of the case 16. The mounts 52 and 70 dampen vibrations emanating from the receiver 11 and minimize vibrations from transmitting to the case 16. The mounts also isolate the receiver 11 from any vibrations occurring outside the case 16. As shown in FIG. 4, a terminal aperture 78 is provided within the second end surface 22 of the case 16 so that the terminals (not shown) of the receiver 11 can pass therethrough.

Figure 7:
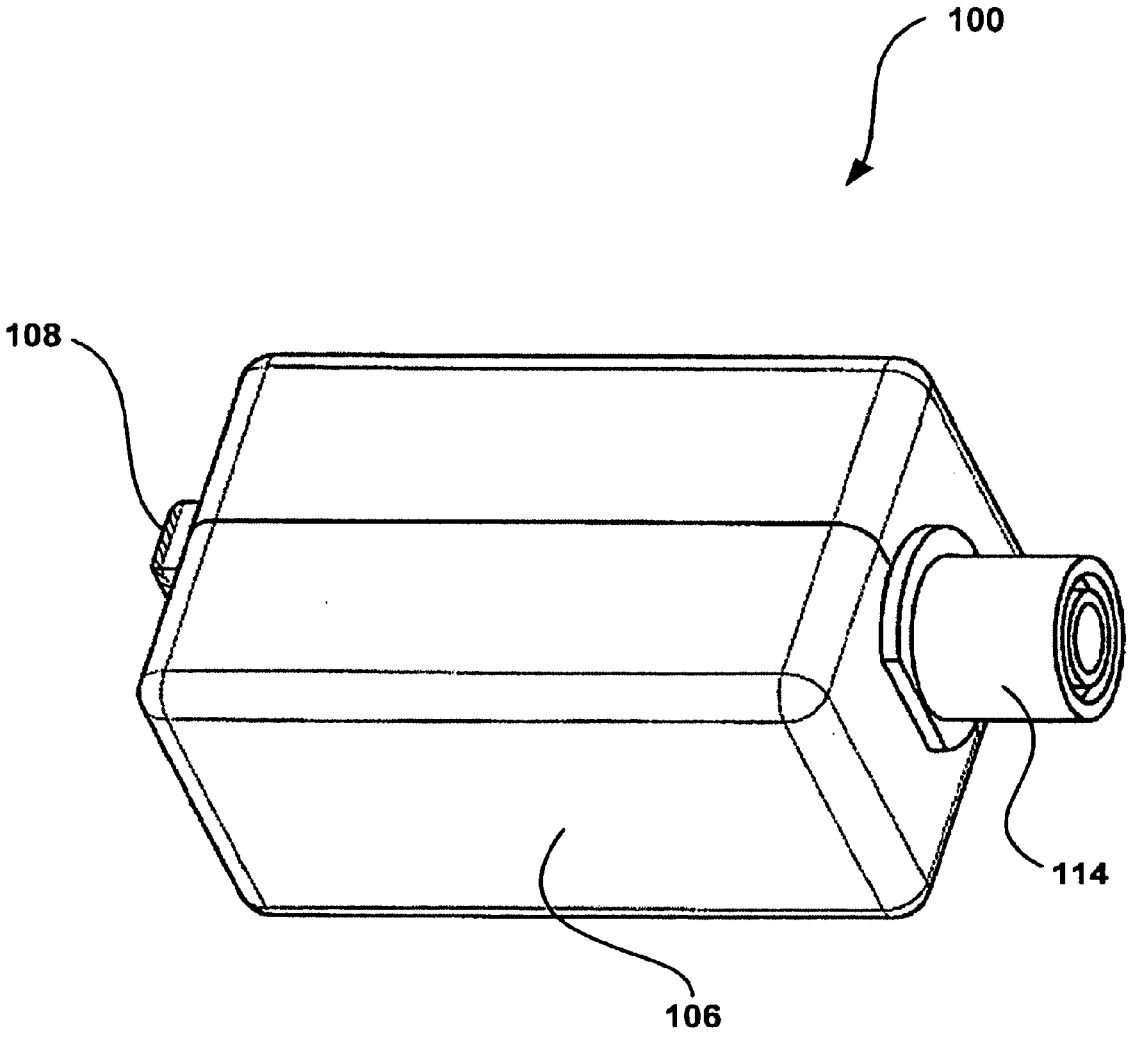
FIG. 7 is a perspective view of a second embodiment of the present invention.
Figure 8:
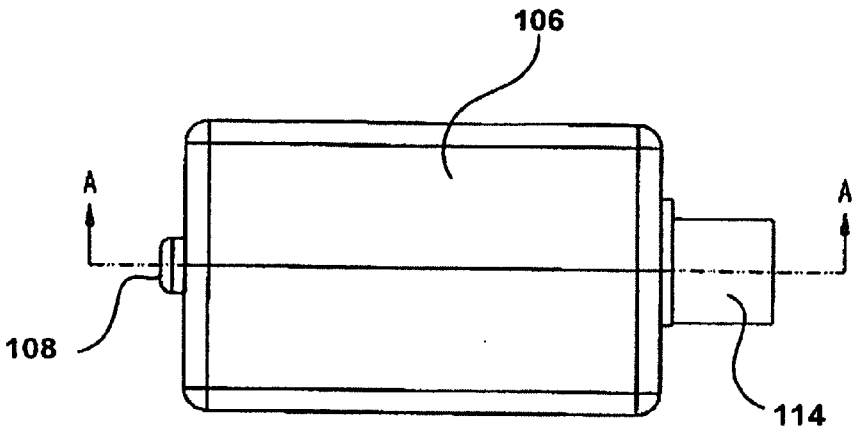
FIG. 8 is a top plan view of the embodiment shown in FIG. 7.
Figure 9:
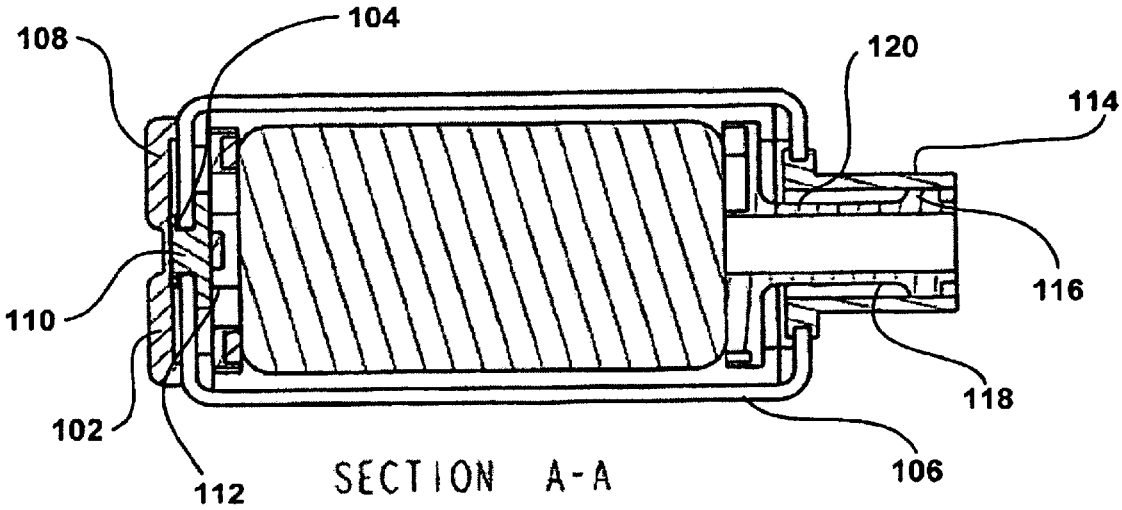
FIG. 9 is a cross-sectional side elevational view taken along section line A—A shown in FIG. 8.

A second embodiment of the present invention is shown in FIGS. 7–9 as a receiver assembly 100. In this embodiment, an integrally formed mount 102 is disposed within a first aperture 104 of a case 106. The mount 102 includes a mount tab 108, a central neck portion 110, and a mounting base 112 all integrally formed in a single piece. Thus, the mount 102 is a single piece as opposed to the two-piece configuration of the first embodiment.

The receiver assembly 100 also includes a cylindrical sleeve 114 that is a modified version of the cylindrical sleeve 28 of the first embodiment. The cylindrical sleeve 114 does not include an annular surface within the cylindrical sleeve to prevent the cylindrical extension of the mount from sliding through the port opening, as in the first embodiment. In the second embodiment, an annular shoulder 116 is disposed on a cylindrical extension 118 of a mount 120 and is frictionally fit within the cylindrical sleeve 114. This second embodiment also effectively isolates the receiver 11 from transmitting vibrations. The mounts 102 and 120 act together to dampen vibration transmission from the receiver 11. The mounts also may act to dampen vibration transmission to the receiver through the case 106.

The scope of the present invention also includes a method of assembling a receiver assembly. The method comprises the steps of:

(1) mounting a first mount having a hollow cylindrical extension to a receiver;

(2) mounting a second mount having a bore to the receiver;

(3) inserting the cylindrical extension of the first mount into a cylindrical sleeve;

(4) inserting one end of a mounting pin into the bore in the second mount;

(5) inserting the receiver into a first case portion having two apertures such that the other end of the mounting pin is disposed within one aperture of the first case portion and the cylindrical sleeve is disposed within the other aperture of the first case portion;

(6) placing a second case portion over the receiver inserted into the first case portion; and (7) joining the first and second case portions together.

It is apparent that one or more steps of assembly may be eliminated by integrally forming various components with other components of the device as described herein. Furthermore, the method used to join the case portions will depend on material selections. If plastic or metal is used for the case portions, they may be joined by welding, adhesive, or other mechanical means.

While the specific embodiments have been illustrated and described, numerous modifications may come to mind without significantly departing from the spirit of the invention, and the scope of protection is only limited by the scope of the accompanying claims.

What is claimed is:

1. A vibration-dampening receiver assembly adapted for use in a hearing aid device, the assembly comprising:

an inner receiver housing;

an outer receiver case defining two ends and encasing the inner receiver housing, the outer receiver case including a generally cylindrical sleeve that extends from the one end of the case and defines a port located at the one end and defining an interior surface an interior cavity, the port allowing the receiver to transmit acoustical energy therethrough;

a vibration-dampening mount disposed between the outer receiver case and the inner receiver housing, wherein the mount engages the inner receiver housing proximate an end portion of the outer receiver case, thereby suspending the inner receiver housing within the interior cavity of the outer receiver case;

said vibration-dampening mount having a first mount and a second mount, the first mount having a generally cylindrical portion having an aperture therethrough, the cylindrical portion of the first mount disposed within the cylindrical sleeve of the case, an aperture in the other end of the outer receiver case; and a mounting pin disposed within the aperture of the outer receiver case such that movement of the pin is generally restricted in a direction generally transverse to the ends of the outer receiver case, the second mount connected to the mounting pin.

2. A vibration-dampening assembly for a receiver adapted for use in a hearing aid device, the assembly comprising:

an inner receiver housing;

an outer receiver case encasing the inner receiver housing, the outer receiver case having two portions generally defining halves of the case, the two halves together defining an interior surface, an interior cavity, a first outer receiver case end and a second outer receiver case end, the first outer receiver case end having a generally cylindrical sleeve defining a port and the second outer receiver case end having an aperture, the port allowing the inner receiver housing to transmit acoustical energy therethrough;

a first vibration-dampening mount having a hollow cylindrical portion disposed within the cylindrical sleeve between the interior surface of the outer receiver case and the receiver housing;

a mounting pin disposed within the aperture in the second outer receiver case end; and a second vibration-dampening mount connected to the mounting pin and the inner receiver housing, the second mount being disposed between the interior surface of the outer receiver case and the inner receiver housing, wherein the first and second mounts support the inner receiver housing within the interior cavity of the outer receiver case and substantially prevent contact between the inner receiver housing and the interior surface of the outer receiver case.

* * * * *